US005882100A

United States Patent [19]

Röck

[11] Patent Number: 5,882,100

[45] Date of Patent: Mar. 16, 1999

[54] PULL OUT GUIDE ASSEMBLY FOR DRAWERS AND THE LIKE

[75] Inventor: Erich Röck, Höchst, Austria

[73] Assignee: Julius Blum Gesellschaft m.b.H., Höchst, Austria

[21] Appl. No.: 946,656

[22] Filed: Oct. 7, 1997

[30] Foreign Application Priority Data

Oct. 7, 1996 [AT] Austria ..... A 1764/96
Oct. 25, 1996 [AT] Austria ..... GM 627/96

[51] Int. Cl.[6] ..... A47B 88/00

[52] U.S. Cl. ..... 312/334.34; 312/334.39; 312/334.33

[58] Field of Search ..... 312/334.14, 334.15, 312/334.32, 334.33, 334.34, 334.6, 334.12, 334.13; 384/18, 19

[56] References Cited

U.S. PATENT DOCUMENTS 2,162,318 6/1939 Schmitz ..... 312/334.33
5,769,518 6/1998 Grabher ..... 312/334.15

FOREIGN PATENT DOCUMENTS 372 830 11/1983 Austria .
000 243 6/1995 Austria .
401 712 4/1996 Austria .
0 226 389 6/1987 European Pat. Off. .
0 720 824 7/1996 European Pat. Off. .
1 127 644 6/1955 France .
26 13 775 10/1977 Germany .
5123227 5/1993 Japan ..... 312/334.6
2168597 6/1986 United Kingdom ..... 312/334.33

*Primary Examiner*—Peter M. Cuomo
*Assistant Examiner*—Gosson A. Anderson
*Attorney, Agent, or Firm*—Wenderoth, Lind & Ponack, L.L.P.

[57] ABSTRACT

A pull-out guide assembly for a drawer or the like includes a support rail to be fastened to a furniture side wall, a pull-out rail to be fastened to the drawer and an intermediate rail on each side of the drawer. Running rollers transfer the load of the drawer from one rail to another. The running rollers are held in cage-like running carriages. Driving rollers which run on the supporting rail and the pull-out rail are mounted on the intermediate rail. The intermediate rail has a U-shaped or double T-shaped profile with upper and lower horizontal running flanges and a vertical connecting web. All running rollers are situated between the running flanges of the intermediate rail. A supporting roller for the pull-out rail is mounted at the front end of the intermediate rail.

12 Claims, 10 Drawing Sheets

6
17,18
29
32
8
15
21
36
23
28
7
27
24
35
12,13
29
14
31
5
33
30
22
34

8
28
29
15
11
25
27
6
5
29
14
30
7

28
29
8
16
26
6
5
7

PULL OUT GUIDE ASSEMBLY FOR DRAWERS AND THE LIKE

BACKGROUND OF THE INVENTION

1. Field of the Invention

The present invention relates to a pull-out guide assembly for use on each of opposite sides of a drawer to guide movement of the drawer into and out of an article of furniture. Such assembly includes a support rail to be attached to a furniture side wall, a pull-out rail to be attached to the drawer, an intermediate rail between the support rail and the pull-out rail, running carriages which hold load-transmitting running rollers arranged between the rails, and a driving roller for controlling movement of the intermediate rail. The driving roller runs on flanges of the support rail and the pull-out rail. The intermediate rail has a U-shaped profile or a double T-shaped profile, each profile including upper and lower running flanges and a vertical connecting web. All of the load transmitting running rollers of the running carriages are situated within the running flanges of the intermediate rail. The support rail and the pull-out rail have at their sides U-shaped profiles with horizontal connecting flanges and horizontal running flanges, the connecting flanges being broader than the running flanges.

2. Description of the Prior Art

Different types of pull-out guide assemblies are known with which a drawer can be pulled from the body of an article of furniture over the entire length of the drawer, with the drawer still being anchored to the support rails on the sides of the body of the article of furniture. With so-called differential pull-out guides which comprise three rails on each side, i.e. a pull-out rail on the side of the drawer, a supporting rail on the side of the body and an intermediate rail differentially running between the two other rails, structure is provided that ensure that the three rails are always in correct position to each other. Such structure, for example, may be driving rollers connected to the intermediate rail and running on flanges of the pull-out rail and the support rail.

SUMMARY OF THE INVENTION

It is an object of the invention to provide a pull-out guide assembly of the aforementioned type and including three rails on each side of the drawer, but which is very compact, which needs little space within the cabinet, and which nevertheless is able to carry drawers with heavy loads. It should advantageously be possible to mount such an assembly underneath a bottom plate of the drawer.

According to the present invention this object is achieved by a supporting roller for the pull-out rail being mounted at the front end of the intermediate rail and in that the driving roller runs between the running flanges of the support rail and the pull-out rail. As all running rollers are situated within running webs of the intermediate rail, the assembly requires only a small amount of space within the cabinet.

BRIEF DESCRIPTION OF THE DRAWINGS

In the following, embodiments of the present invention will be described in greater detail with reference to the accompanying drawings, wherein.

DETAILED DESCRIPTION OF THE INVENTION

Figure 1:
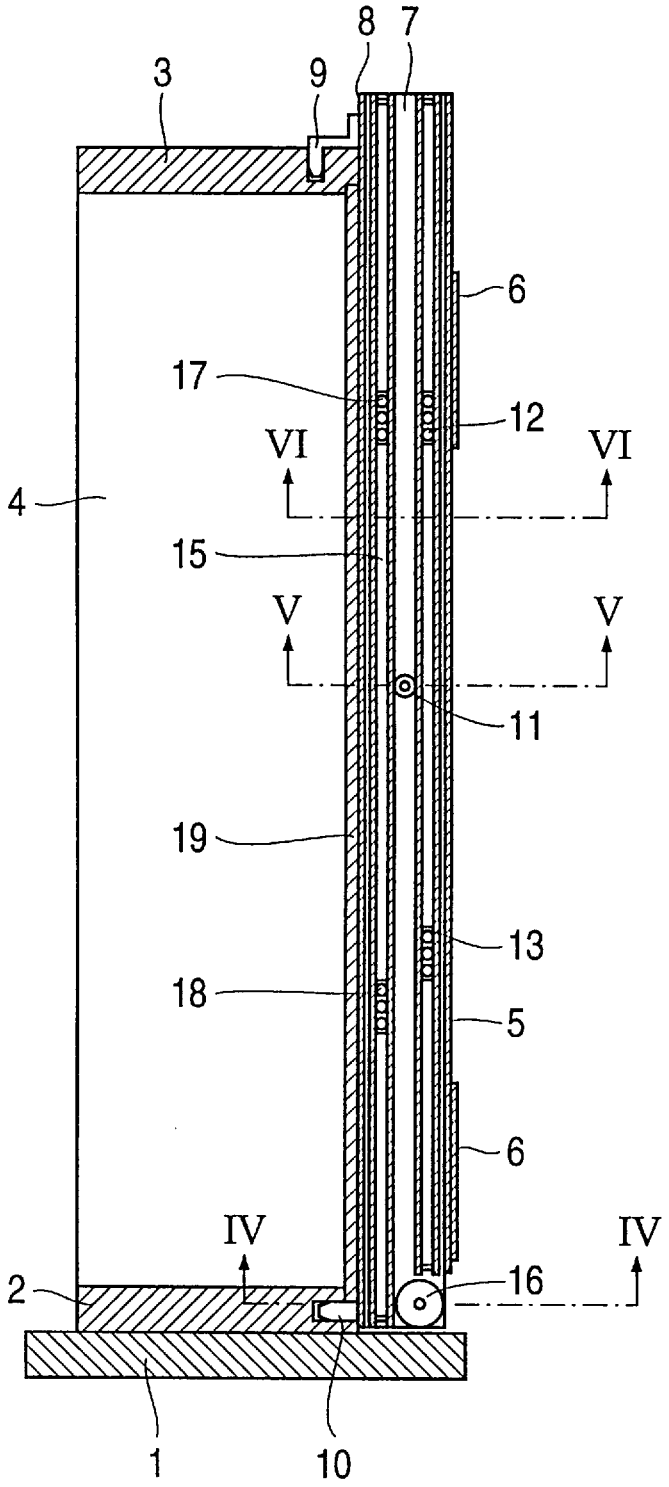
FIG. 1 is a longitudinal sectional view of the rails of the pull-out guide assembly, a drawer being shown in an inserted position.
Figure 2:
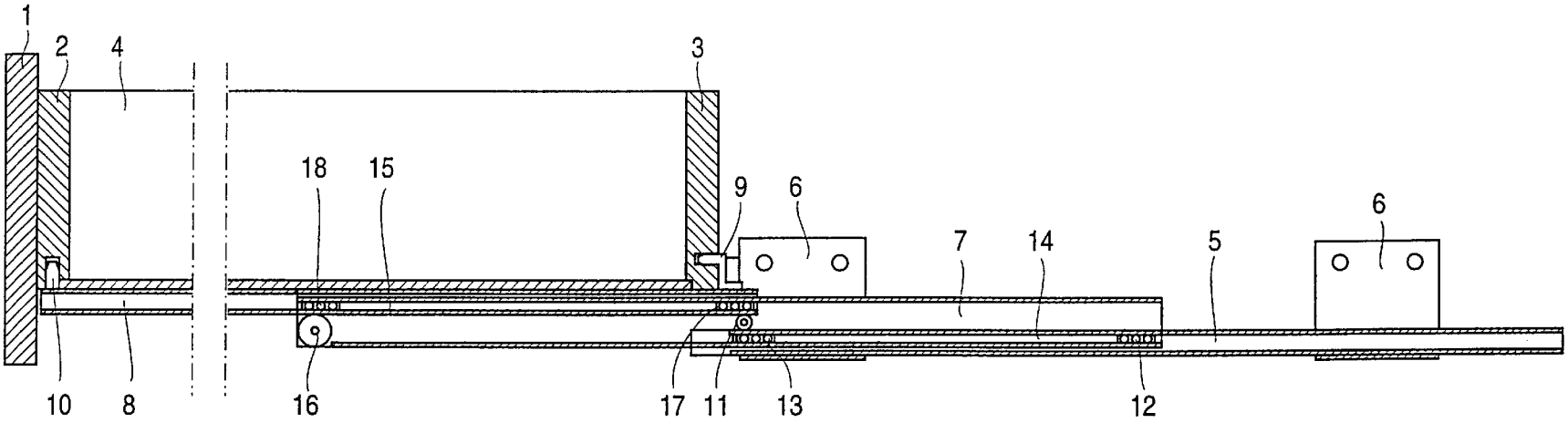
FIG. 2 is a longitudinal sectional view of the rails of the pull-out guide assembly, the drawer being shown extracted from the body of an article of furniture.
Figure 3:
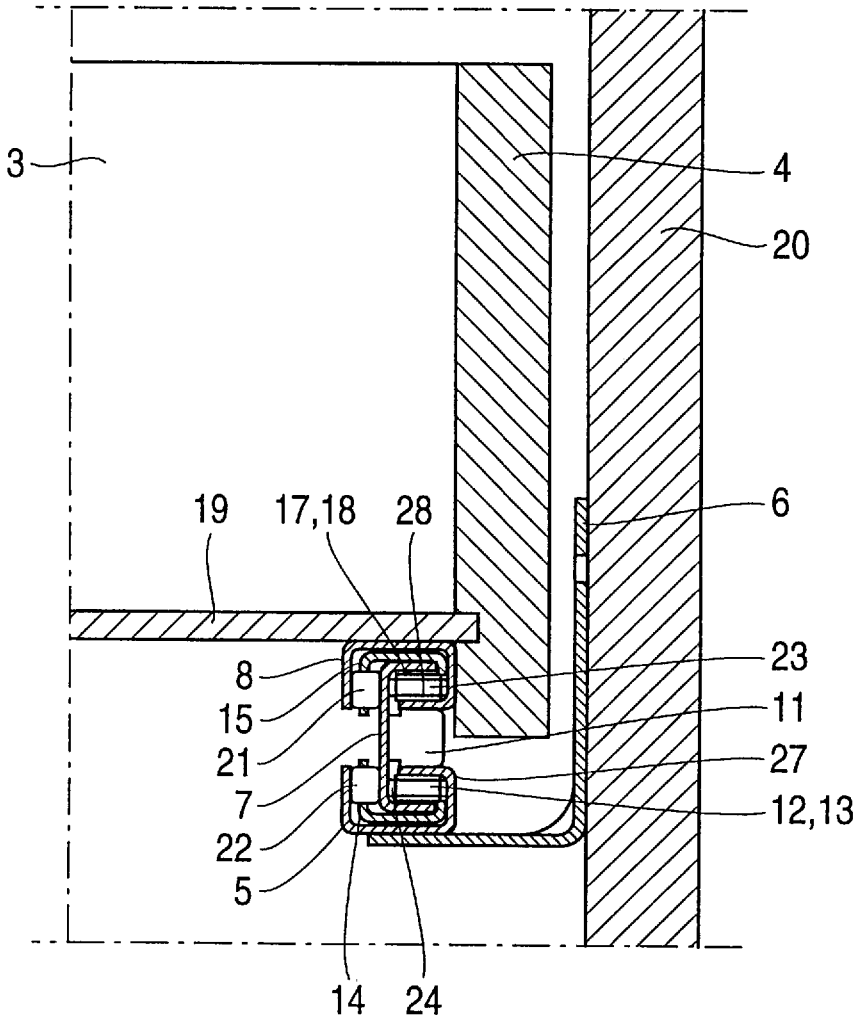
FIG. 3 is a cross-sectional view of a side wall of the drawer and the rails of the pull-out guide assembly according to a first embodiment of the invention.
Figures 4, 5, 6:
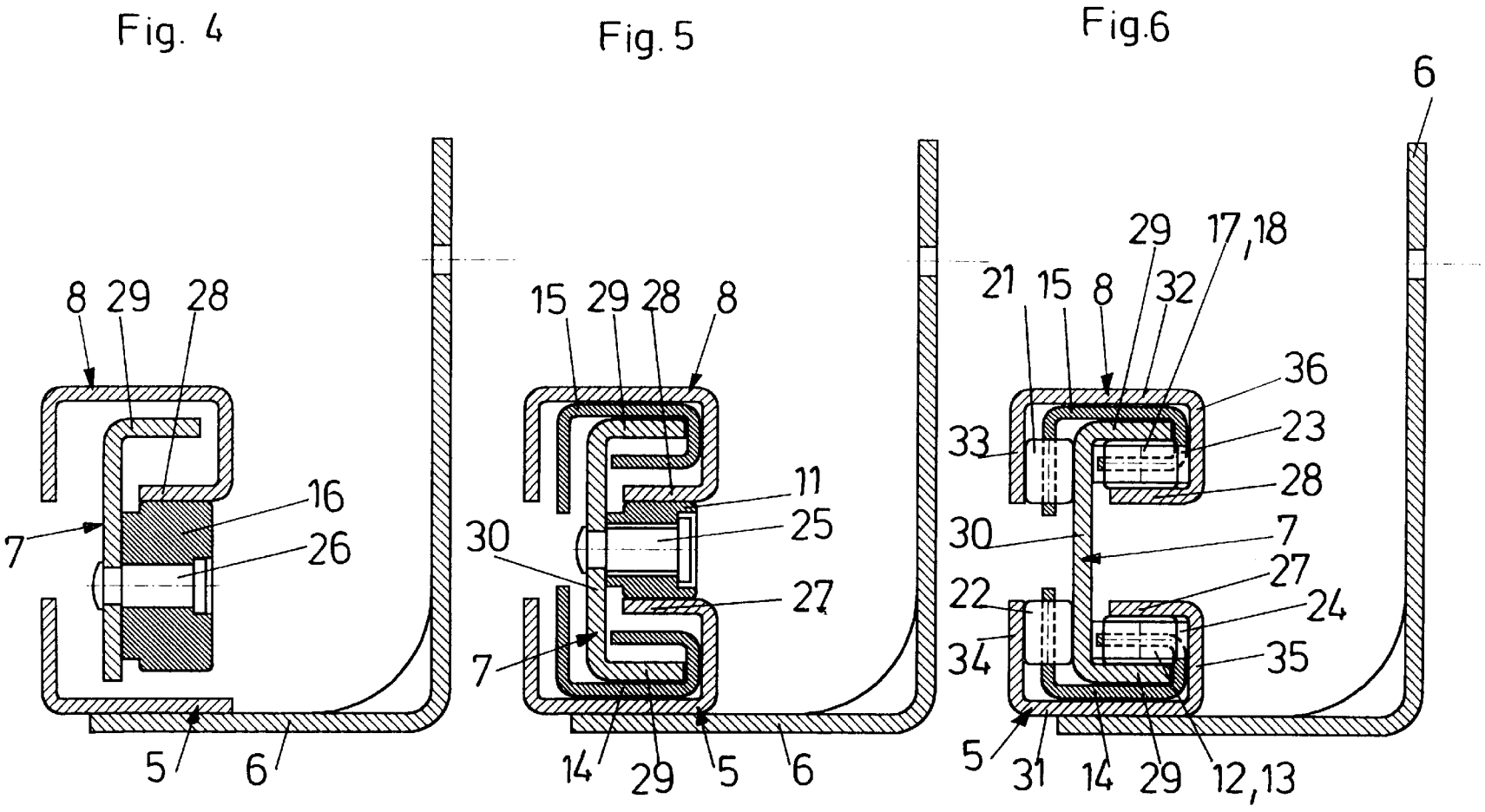
FIG. 4 is a sectional view taken along line IV—IV of FIG. 1.
FIG. 5 is a sectional view taken along line V—V of FIG. 1.
FIG. 6 is a sectional view taken along line VI—VI of FIG. 1.
Figure 7:
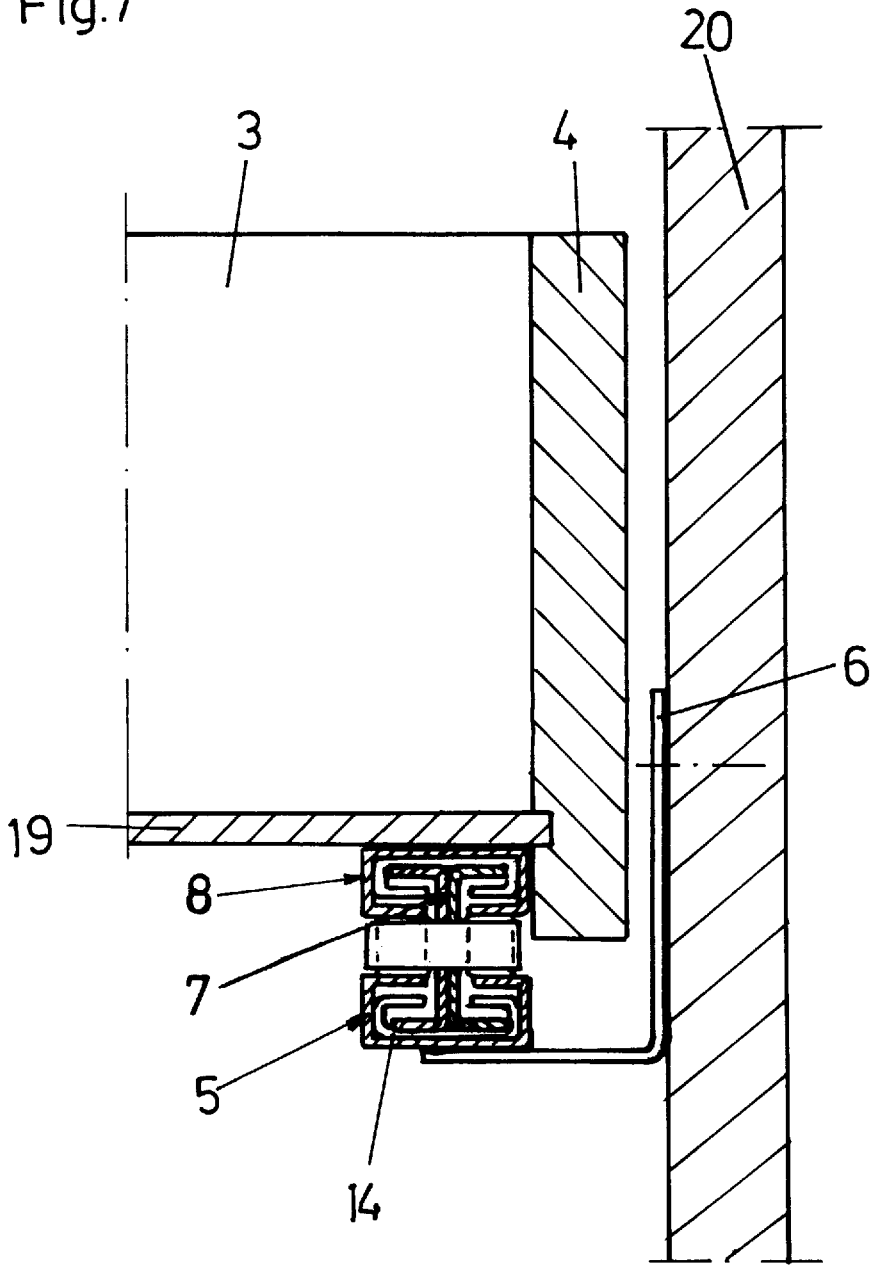
FIG. 7 is a sectional view of a drawer side wall and rails of a pull-out guide assembly according to a second embodiment of the invention.
Figure 9:
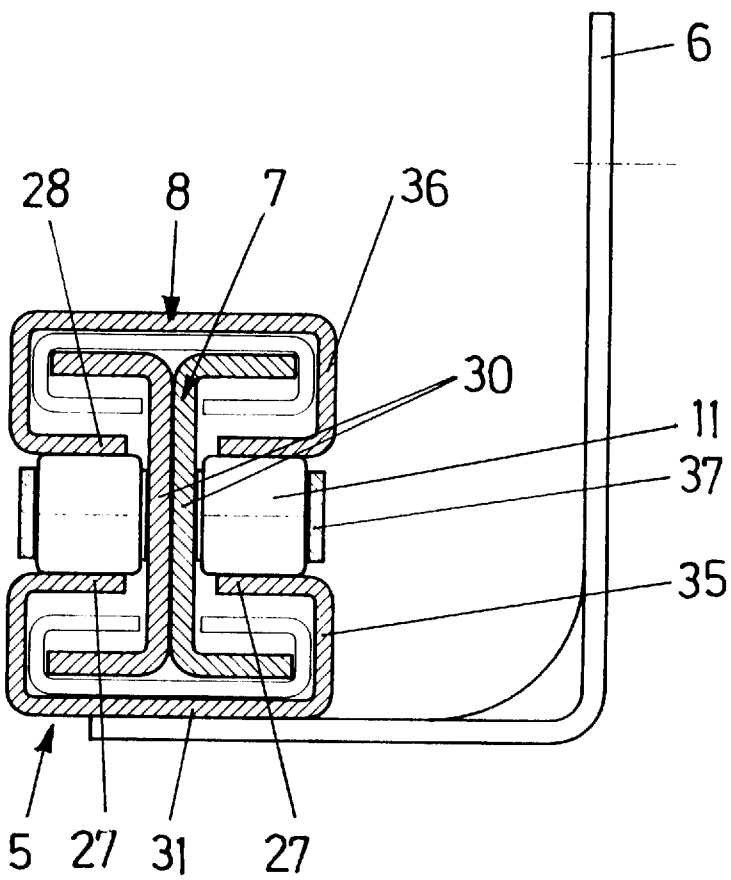
FIGS. 8 to 13 are sectional views similar to FIGS. 4 to 6, but according to two further embodiments of the invention.
Figure 8:
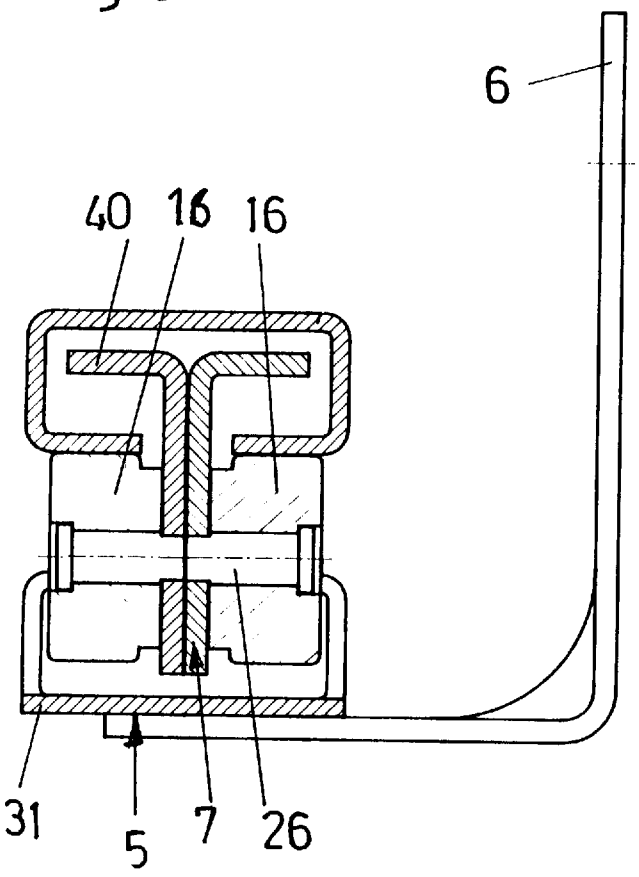

The drawings show only those members of the pull-out guide assembly which are laterally arranged on one side of a drawer. The second part of the pull-out guide assembly which is mounted on the other side of the drawer is of an analogous configuration.

A pull-out rail 8 is positioned underneath a bottom plate 19 of the drawer next to side wall 4 of the drawer. The pull-out rail 8 is provided at its front end with a lug 10 extending upwardly and projecting into a hole in front plate 2 of the drawer and is provided at its rear end with a hook 9 protruding into a horizontal hole in rear wall 3 of the drawer. In front of the front plate 2 is mounted a front panel 1 which extends downwardly beneath the bottom plate 19 covering the pull-out guide assembly from the front. A support rail 5 is fastened to a respective side wall 20 of a cabinet by means of webs 6. The webs 6 are advantageously attached to the side wall 20 of the cabinet by screws. An intermediate rail 7 is situated between each support rail 5 and each pull-out rail 8. The intermediate rail 7 is moved differentially between the support rail 5 and the pull-out rail 8.

Approximately the middle of the intermediate rail 7 has mounted thereon a driving roller 11. The driving roller 11 runs between horizontal running flanges 27, 28 of the support rail 5 and the pull-out rail 8. In the embodiment of FIGS. 3 to 6 the driving roller 11 is mounted on the intermediate rail by means of an axle 25 in the form of pivoted pin. There is enough clearance between the axle 25 and the driving roller 11 so that the load of the drawer is transferred directly from the pull-out rail 8 over the driving roller 11 to the support rail 5 and does not act on the axle 25 of the intermediate rail 7.

A supporting roller 16 is provided at the front end of the intermediate rail 7. The supporting roller 16 is mounted on the intermediate rail by means of an axle or pin 26, and the pull-out rail 8 rests on the supporting roller 16. In the embodiments of the FIGS. 3 to 6 the intermediate rail 7 has a U-shaped profile with upper and lower running flanges 29 and a vertical connecting web 30. The running flanges 29 project between the horizontal running flanges 27, 28 and horizontal connecting flanges 31, 32 of the support rail 5 and the pull-out rail 8. The running flanges 27, 28 are not as broad as the horizontal connecting flanges 31, 32 of the support rail 5 and the pull-out rail 8.

Cage-like running carriages 14, 15 are situated between the rails 5, 7, 8. Running rollers 12, 13, 17, 18 and laterally acting compensating rollers 21, 22, 23, 24 are mounted in the running carriages 14, 15. All the running rollers 12, 13, 17, 18 are situated with the U-profile of the intermediate rail 7. The running rollers 12, 13 run between the lower running flange 29 of the intermediate rail 7 and the horizontal running flange 27 of the supporting rail 5. The running rollers 17, 18 run between the horizontal flange 28 of the pull-out rail 8 and the upper running flanges 29 of the intermediate rail 7. The support rail 5 and the pull-out rail 8 are provided with vertical side flanges 33, 34. Lateral compensating rollers 21, 22 run between the vertical side flanges 33, 34 and the vertical connecting web 30 of the intermediate rail 7. Lateral compensating rollers 23, 24 run between the connecting web 30 of the intermediate rail 7 and vertical side flanges 35, 36 of the support rail 5 and the pull-out rail 8. When the drawer is in the inserted position the running carriages 14, 15 with the running rollers 13, 18 are situated in front of the driving roller 11 and the running carriages 14, 15 with the running rollers 12, 17 are situated behind the driving roller 11. When the drawer is in its full extracted position the running rollers 17 and 13 are situated directly above and underneath the driving roller 11. The running rollers 12, 13, 17, 18 as well as the lateral compensating rollers 21, 22, 23, 24 are cylindrical.

In the embodiment of FIG. 7 to 15 the intermediate rail 7 has a double T-shaped cross section or profile. The intermediate rail 7 could be made of one piece. However, in the embodiment shown the intermediate rail 7 is made of two rail members 7' each having a U-shaped profile, connecting webs 30 of the rail members 7' being situated adjacent to each other. The rail members 7' are preferably made of steel.

In the embodiment of FIG. 7 to 14, the middle of intermediate rail 7, with regard to the length thereof, is provided with two driving rollers 11 which run between the running flanges 27, 28 of the support rail 5 and the pull-out rail 8. The driving rollers 11 are held at the intermediate rail by means of a pair of bows or clips 37. The load of the drawer is always transmitted from the pull-out rail 8 by means of the driving rollers 11 to the support rail 5 and does not affect the intermediate rail 7 in the region of the driving rollers 11. There is a driving roller 11 at each side of the intermediate rail 7. In the case of drawers for very heavy loads it is possible to provide two or more driving rollers 11 at each side of the intermediate rail 7 in tandem arrangement. Arms 38 of each of the bows or clips 37 are provided with respective hooks 39 which rest in recesses 40 in the arms 38 of the other bows 37. The arms 38 project through holes in the connecting flanges of the rails 7' which together form the intermediate rail 7.

At the front end of the intermediate rail 7 are provided two supporting rollers 16 on which the pull-out rail 8 rests. The two supporting rollers 16 are mounted on a common pin 26. Also in this embodiment, the intermediate rail 7 is provided with upper and lower running flanges 29. The running flanges 29 extend between horizontal running flanges 27, 28 and horizontal connecting flanges 31, 32 of the support rail 5 and the pull-out rail 8.

Pull-out carriages 14, 15 with running rollers 12, 13, 17, 18 and lateral compensating rollers 21, 22, 23, 24 are situated between the rails 5, 7, 8. All of the running rollers 12, 13, 17, 18 and the lateral compensating rollers 23, 24 are situated within the profile of the intermediate rail 7.

Figure 11:
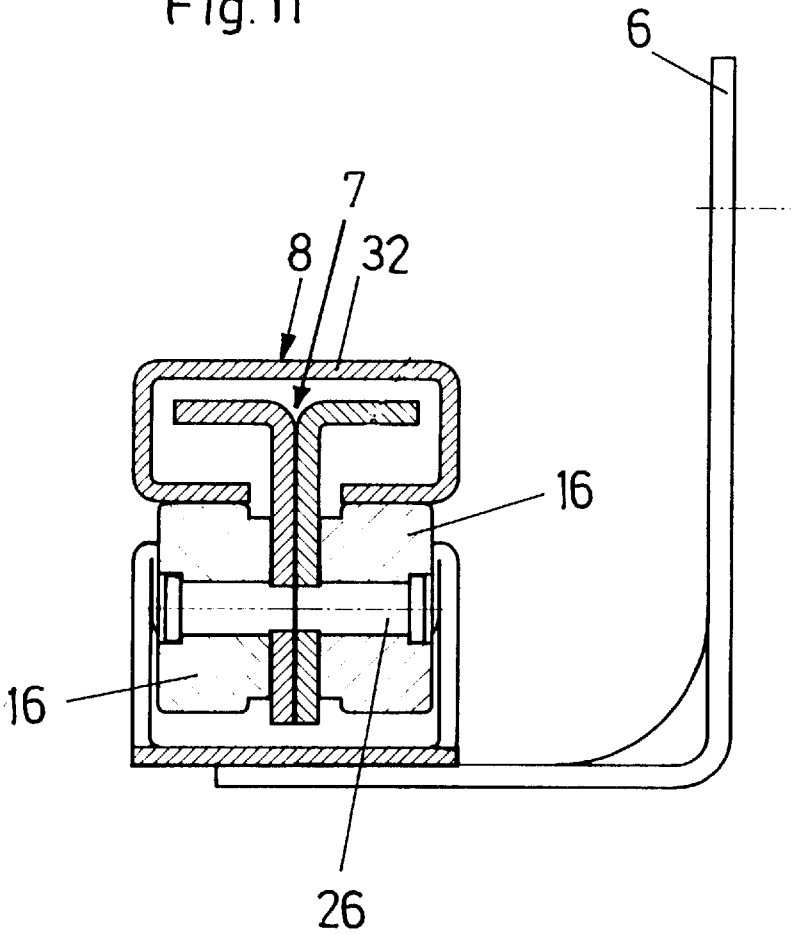
Figure 10:
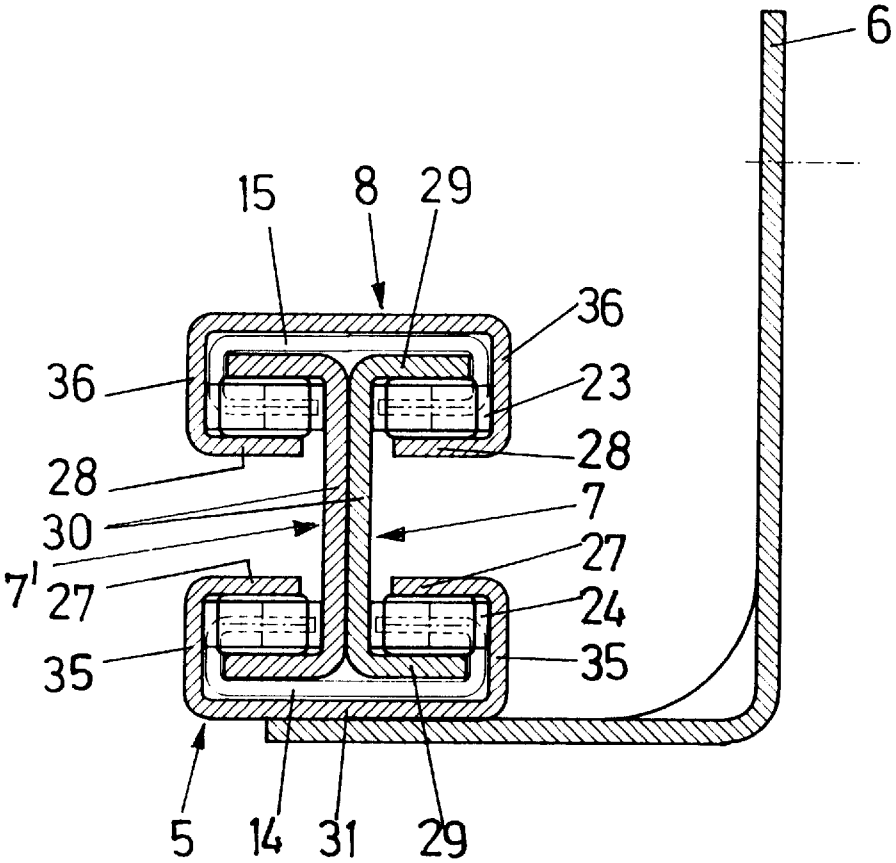
Figure 13:
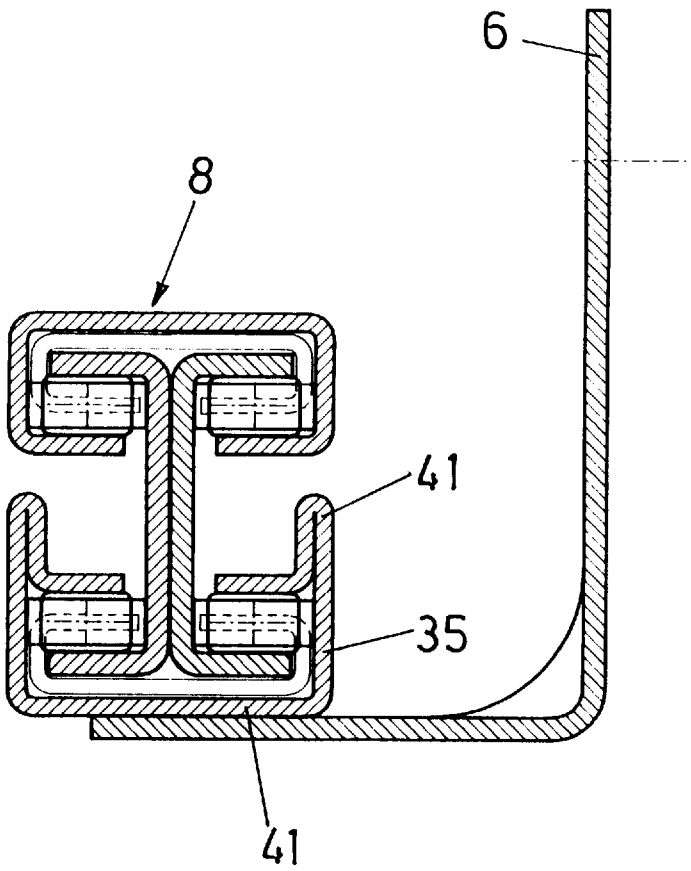
Figure 12:
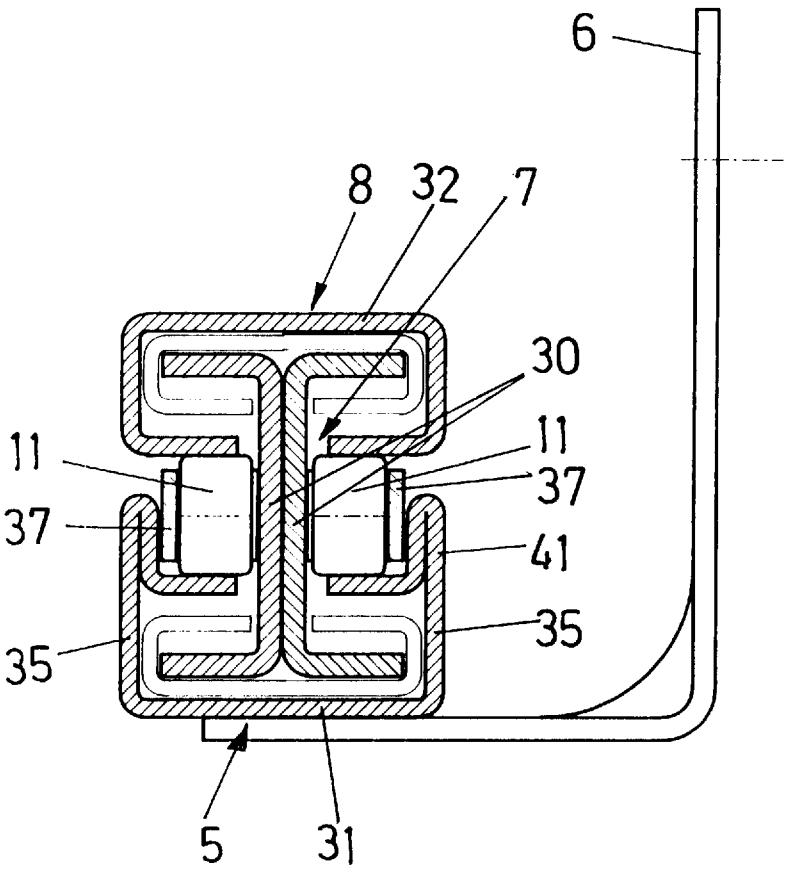
Figure 14:
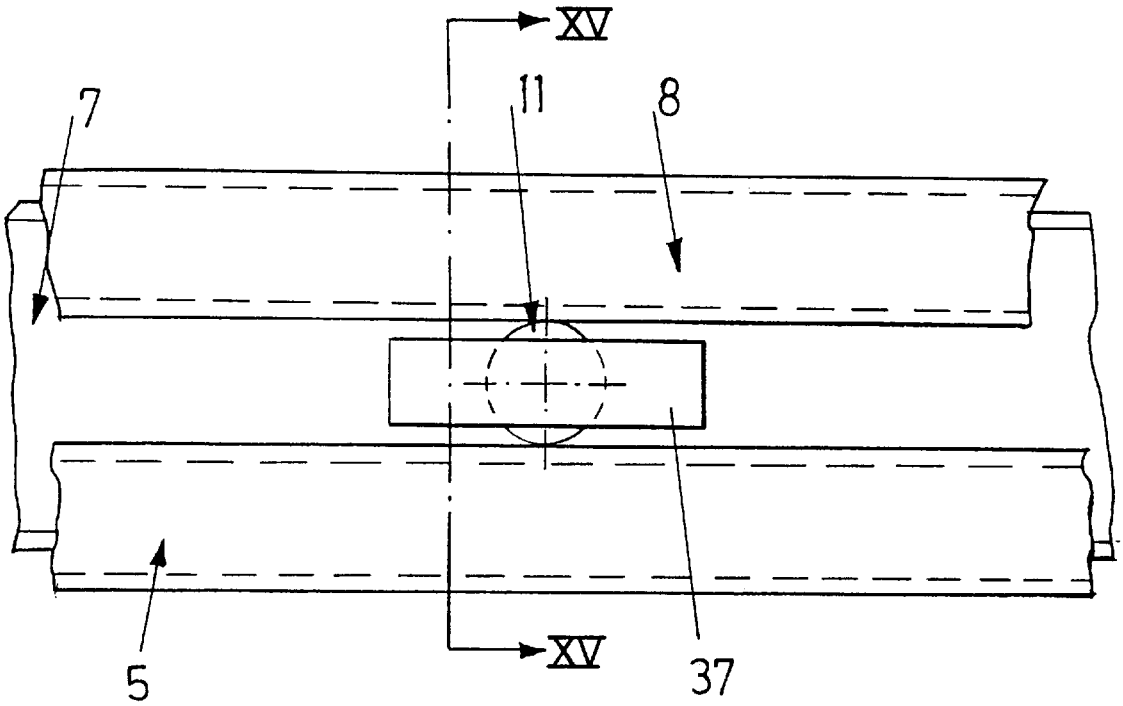
FIG. 14 is a side view of the pull-out guide assembly including driving roller.
Figure 15:
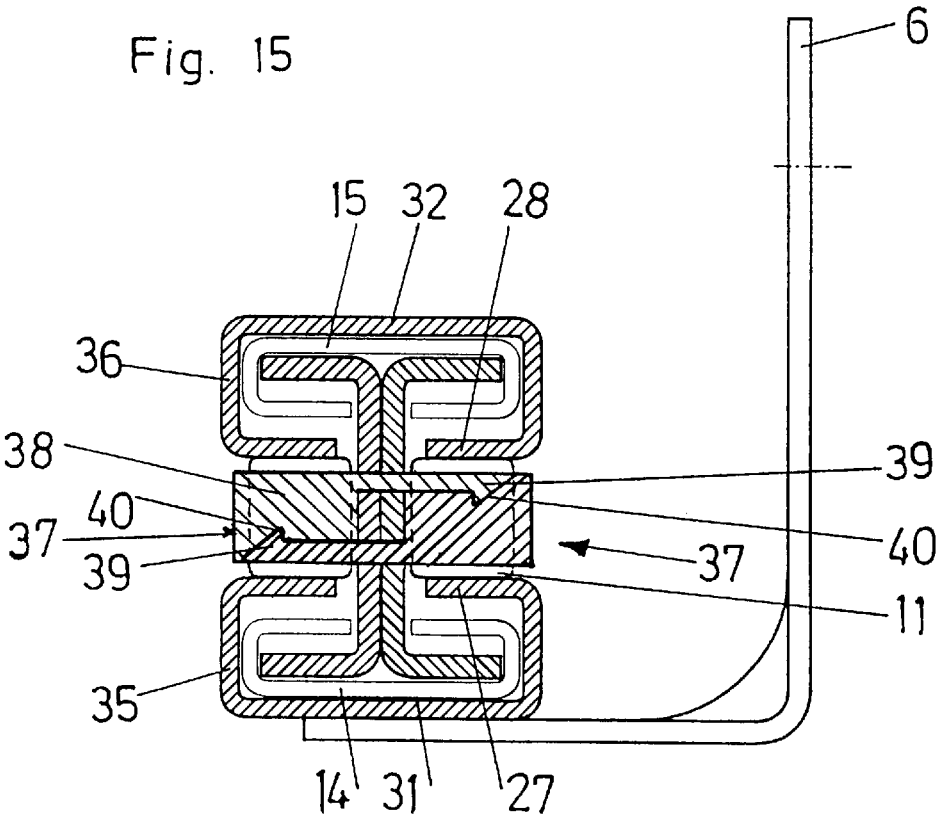
FIG. 15 is a sectional view taken along line XV—XV of FIG. 14.
Figure 16:
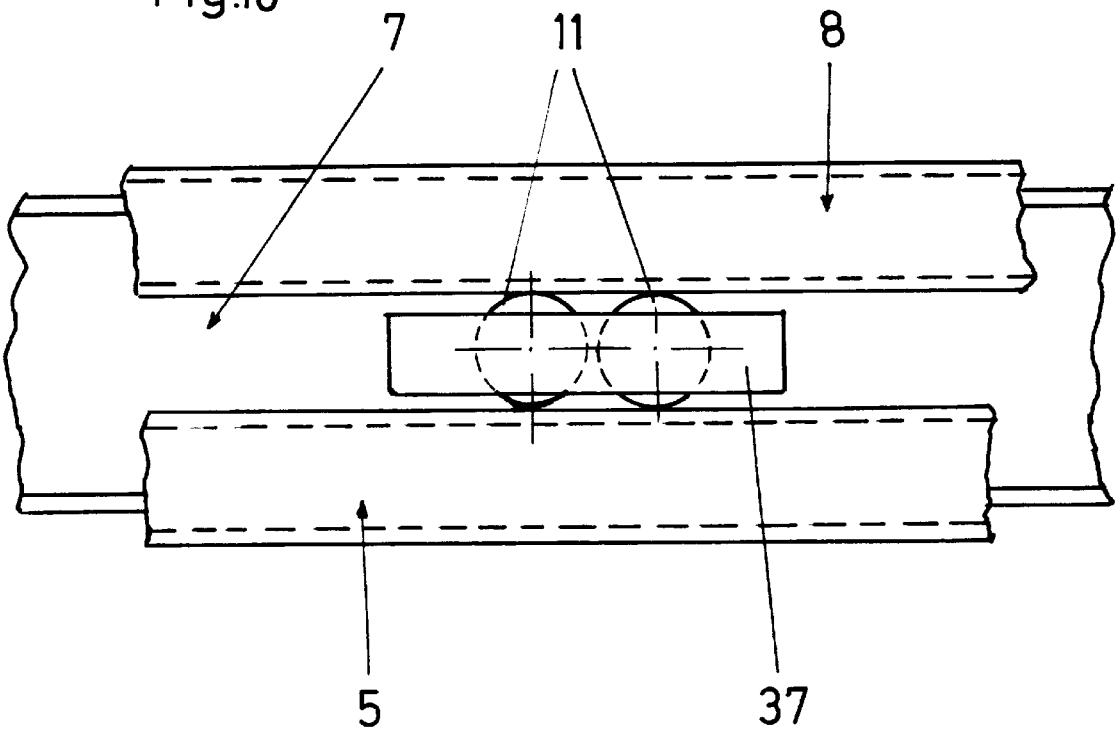
FIG. 16 is a view similar to FIG. 14, but wherein two driving rollers are mounted at an intermediate rail.

In the embodiment according to FIGS. 11 to 13, lateral or side flanges 35 of the support rail 5 are folded at 41, so that over a part of the length of the support rail 5 the lateral flanges 35 are of double thickness and therefore stronger. The folded areas 41 of the lateral flanges 35 extend upwardly from the horizontal flanges 27 of the support rail 5 in the direction of the pull-out rail 8. At the front end of the support rail 5, the lateral flanges 35 and the running flanges 27 are provided with a cut-out of sufficient size room for the supporting rollers 16.

What is claimed is:

1. A pull-out guide assembly for use on each of opposite sides of a drawer to guide movement of the drawer into and out of an article of furniture, said assembly comprising:

a support rail to be attached to a furniture side wall;

a pull-out rail to be attached to the drawer;

an intermediate rail between said support rail and said pull-out rail, said intermediate rail having a U-shaped or a double T-shaped profile including upper and lower running flanges and a vertical connecting web;

running carriages arranged between said rails, said carriages including load-transmitting rollers situated between said running flanges of said intermediate rail;

said support rail and said pull-out rail each having a U-shaped profile including a horizontal connecting flange and at least one horizontal running flange connected by at least one vertical side flange, said connecting flanges being broader than said running flanges;

a driving roller secured to said intermediate rail for controlling movement of said intermediate rail, said driving roller running between said running flanges of said support rail and said pull-out rail; and a supporting roller mounted at a front end of said intermediate rail for supporting said pull-out rail.

2. An assembly as claimed in claim 1, wherein each of said running flanges of said intermediate rail extends between said horizontal connecting flange and said horizontal running flange of a respective of said support rail or said pull-out rail.

3. An assembly as claimed in claim 1, wherein said intermediate rail is formed by two rail members, each said rail member having a U-shaped profile and including a said vertical connecting web, said connecting webs of said two rail members being adjacent each other.

4. An assembly as claimed in claim 1, comprising at least two driving rollers.

5. An assembly as claimed in claim 4, wherein at least one said driving roller is provided at each of opposite sides of said intermediate rail.

6. An assembly as claimed in claim 4, comprising at least two driving rollers provided at one said side of said intermediate rail.

7. An assembly as claimed in claim 4, comprising at least two driving rollers provided in tandem arrangement at each said side of said intermediate rail.

8. An assembly as claimed in claim 4, wherein said driving rollers are held at said intermediate rail by U-shaped clips including arms extending through said connecting web of said intermediate rail and interlocking said clips with each other.

9. An assembly as claimed in claim 1, comprising two supporting rollers mounted on said intermediate rail by a common axle.

10. An assembly as claimed in claim 1, wherein said supporting roller has a diameter greater than a diameter of said driving roller.

11. An assembly as claimed in claim 1, wherein said at least one vertical side flange of said support rail is folded.

12. An assembly as claimed in claim 1, wherein said driving roller extends beyond said running flanges of said intermediate rail in a lateral direction of said intermediate rail.

* * * * *